US010458746B2

(12) United States Patent
Frazier et al.

(10) Patent No.: US 10,458,746 B2
(45) Date of Patent: Oct. 29, 2019

(54) ADJUSTABLE CHEEK RISER

(71) Applicant: Sig Sauer, Inc., Newington, NH (US)

(72) Inventors: Kenneth Samuel Frazier, Salem, NH (US); Aaron C. Sakash, Somersworth, NH (US)

(73) Assignee: Sig Sauer, Inc., Newington, NH (US)

( * ) Notice: Subject to any disclaimer, the term of this patent is extended or adjusted under 35 U.S.C. 154(b) by 0 days.

(21) Appl. No.: 15/999,374

(22) Filed: Aug. 20, 2018

(65) Prior Publication Data

US 2019/0056192 A1 Feb. 21, 2019

Related U.S. Application Data

(60) Provisional application No. 62/548,099, filed on Aug. 21, 2017.

(51) Int. Cl.
*F41C 23/14* (2006.01)

(52) U.S. Cl.
CPC ..... *F41C 23/14* (2013.01)

(58) Field of Classification Search
CPC ..... F41C 23/14
USPC ..... 42/71.73, 71.01, 73, 75.03
See application file for complete search history.

(56) References Cited

U.S. PATENT DOCUMENTS 7,685,757 B2 * 3/2010 Rohrauer ..... F41A 21/485 42/75.01
7,793,453 B1 * 9/2010 Sewell, Jr. ..... F41C 23/14 42/73
8,307,575 B1 * 11/2012 Battaglia ..... F41A 3/64 42/75.03
9,097,490 B2 * 8/2015 Tseng ..... F41C 23/12
9,664,479 B1 * 5/2017 Robinson ..... F41C 23/14
2009/0288324 A1 * 11/2009 Peterson ..... F41A 11/02 42/75.03
2010/0071246 A1 * 3/2010 Vesligai ..... F41C 23/04 42/75.03
2010/0212205 A1 * 8/2010 Nill ..... F41C 23/04 42/73
2012/0137562 A1 * 6/2012 Langevin ..... F41C 23/14 42/75.03
2013/0180148 A1 * 7/2013 Rogers ..... F41C 23/04 42/73
2013/0212920 A1 * 8/2013 Law ..... F41C 23/14 42/75.03

(Continued)

OTHER PUBLICATIONS

Buttstocks, Online Catalog, Retrieved on Nov. 8, 2018, Retrieved at https://www.fab-defense.com/en/category-buttstocks.html, 10 pages, FAB Defense.

(Continued)

*Primary Examiner* — Joshua E Freeman
*Assistant Examiner* — Bridget A Cochran
(74) *Attorney, Agent, or Firm* — Finch & Maloney PLLC

(57) ABSTRACT

An adjustable cheek riser for a firearm is disclosed herein. The adjustable cheek riser comprises a comb extension member configured to move between at least an expanded configuration and a retracted configuration. The adjustable cheek riser comprises at least one living hinge positioned on the comb extension member and at least one locking element, the at least one locking element being configured to switch between a locked and an unlocked position upon activation of the living hinge.

19 Claims, 7 Drawing Sheets

(56) References Cited

U.S. PATENT DOCUMENTS

| | | | | |
|---|---|---|---|---|
| 2014/0190055 | A1* | 7/2014 | Warburton | F41C 23/14 42/71.01 |
| 2014/0196343 | A1* | 7/2014 | Wilson | F41A 35/06 42/71.01 |
| 2014/0245649 | A1* | 9/2014 | Fluhr | F41C 23/14 42/73 |
| 2014/0259848 | A1* | 9/2014 | Chvala | F41C 23/14 42/73 |
| 2015/0219416 | A1* | 8/2015 | Chvala | F41C 23/04 42/71.01 |
| 2015/0345895 | A1* | 12/2015 | Young | F41A 11/04 42/71.01 |
| 2016/0025448 | A1* | 1/2016 | Kincel | F41C 23/20 42/71.01 |
| 2016/0061559 | A1* | 3/2016 | Wood | F41C 23/20 42/73 |
| 2016/0178305 | A1* | 6/2016 | Ellis | F41A 21/34 42/90 |
| 2016/0202016 | A1* | 7/2016 | Mather | F41C 23/14 42/73 |
| 2018/0073835 | A1* | 3/2018 | Saltzman | F41C 23/08 |
| 2018/0202756 | A1* | 7/2018 | Shinkle | F41C 23/14 |
| 2018/0335273 | A1* | 11/2018 | Doty | F41C 23/14 |

OTHER PUBLICATIONS

CAA AR-15 Adjustable Cheek Piece Picatinny Mount Polymer Black ACP, Online Catalog, Retrieved on Nov. 8, 2018, Retrieved at https://www.cheaperthandirt.com/product/command-arms-accessories-adjustable-cheek-piece-for-cbs-stock-polymer-black-acp-814716012710.do, 3 Pages, Cheaper than Dirt!

MAKO GLR16 Buttstock With Adjustable Cheek Rest Collapsible AR-15, LR-308 Carbine Synthetic, Online Catalog, Retrieved on Nov. 8, 2018, Retrieved at https://www.midwayusa.com/product/318705/mako-glr16-buttstock-with-adjustable-cheek-rest-collapsible-ar-15-lr-308-carbine-synthetic, 3 pages, Midway USA.

* cited by examiner

ADJUSTABLE CHEEK RISER

CROSS-REFERENCE TO RELATED APPLICATIONS

This patent application claims the benefit of U.S. Provisional Patent Application No. 62/548,099, titled "Adjustable Cheek Riser," filed on Aug. 21, 2017, which is herein incorporated by reference in its entirety.

FIELD OF THE DISCLOSURE

The present disclosure relates generally to firearms and, more specifically, to a firearm stock.

BACKGROUND

Firearm design involves a number of non-trivial challenges, including the design of the firearm stock that may include a cheek riser that is typically pressed against a user's cheek while firing. Considerations related to the design of a firearm stock may include selection of various dimensions, for example, the height of the cheek riser against a user's cheek.

SUMMARY

The system and method described in the present disclosure provide an adjustable cheek riser, which is configured to enable and/or disable motion of a cheek riser. The system and method described in the present disclosure provide an adjustable cheek riser which may be an add-on to a firearm. The system and method described in the present disclosure provide an adjustable cheek riser which fits easily into the stock of a firearm. The system and method described in the present disclosure provide an adjustable cheek riser which is configured to operate using a living hinge mechanism. The system and method described in the present disclosure provide an adjustable cheek riser which is configured to switch between an expanded configuration and a retracted configuration. The system and method described in the present disclosure provide an adjustable cheek riser which is configured to operate with a single hand motion by a user. The system and method described in the present disclosure provide an adjustable cheek riser which is configured to enable a user to adjust a sight during operation. As described herein, a cheek riser may refer to a cheek rest, a comb, or a comb extension.

Accordingly, pursuant to one aspect of the present invention, there is contemplated an adjustable cheek riser for a firearm comprising a comb extension member configured to move between at least an expanded configuration and a retracted configuration, at least one living hinge positioned on the comb extension member; and at least one pin, the at least one pin being configured to switch between a locked and an unlocked position upon activation of the living hinge.

The adjustable cheek riser for a firearm may be further characterized by one or any combination of the features described herein, such as the at least one pin passes through a hole or slot on a surface in a lower portion of the comb extension member, the at least one pin is configured to move into a pin recess for locking the position of the comb extension member, the at least one pin is configured to slide along a pin track during switching between the expanded configuration and the retracted configuration, the comb extension member is configured to stop on at least one intermediate position between the expanded configuration and the retracted configuration, the at least one pin is a spring-loaded pin, the at least one living hinge is positioned on at least one side of the comb extension member, activation of the at least one living hinge is configured to release a locking mechanism and slide a tab along a groove, the tab and the groove are positioned at an angle of about 45 degrees with respect to the axis of firing, the comb extension member is positioned on a base, the base is positioned on a carrier, the base is secured on the carrier using a snap fit connection, the carrier is positioned at a rear end of a firearm, an extension at a forward end of the carrier is insertable into the rear end of the firearm and secured using a clip, a tapered contour and a hole at a forward end of the extension mate the extension of the carrier to the rear end of the firearm, the at least one pin is biased toward a locked position.

Pursuant to another aspect of the present disclosure, there is contemplated an adjustable cheek riser for a firearm comprising a comb extension member configured to move between at least an expanded configuration and a retracted configuration, at least one button positioned on the comb extension member, and at least one pin, the at least one pin being configured to switch between a locked and an unlocked position upon activation of the button.

Pursuant to yet another aspect of the present disclosure, there is contemplated a method for adjusting a cheek riser of a firearm, the method comprising pressing on a grip portion of at least one living hinge, shifting a locking mechanism from a locked position to an unlocked position, and moving the cheek riser to a desired height.

The method for adjusting a cheek riser of a firearm may be further characterized by one or any combination of the features described herein, such as releasing the grip portion of the at least one living hinge, shifting the locking mechanism from an unlocked position to a locked position The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the inventive subject matter.

Figure 1:
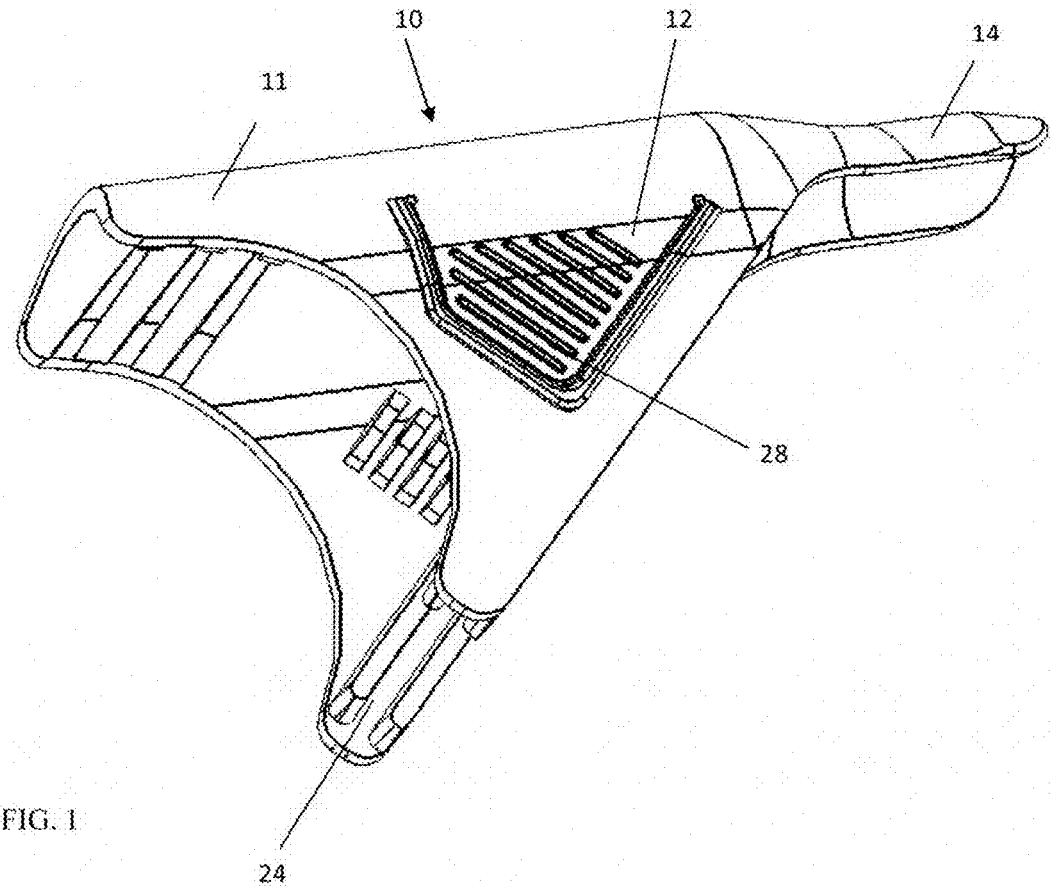
FIG. 1 is a perspective view of a cheek riser, in accordance with one embodiment of the present disclosure.

These and other features of the present embodiments will be understood better by reading the following detailed description, taken together with the figures herein described. The accompanying drawings are not intended to be drawn to scale. For purposes of clarity, not every component may be labeled in every drawing.

DETAILED DESCRIPTION

In one aspect, a system and method are described that allows a cheek riser to be quickly and easily adjustable. The cheek riser described herein may be configured to be quickly installed on a rifle stock. In some embodiments, the cheek riser described herein is configured to snap into and out of place. In some embodiments, the cheek riser is configured with a living hinge. In some embodiments, the cheek riser can be easily installed on a rifle stock. In some embodiments, the cheek riser snaps into and out of place. In some embodiments, the cheek riser adjusts between two positions and positively locks into place. In some embodiments, the cheek riser is configured to lock into more than two positions. In some embodiments, the cheek riser is configured to stop at a down position, an up position, and at least one intermediate position. In some embodiments, the cheek riser is configured to switch between an expanded configuration and a retracted configuration.

In some embodiments, it may be necessary to switch between two distinct sighting systems, placed in two distinct vertical planes. For example, it may be necessary to switch from a magnified optic to an iron sight or other non-magnified optic in a rapid engagement at a new distance from a target. The cheek riser described herein is configured to be adjusted between vertical planes in a quick, intuitive, and ergonomic manner. A user may grasp and depress one or more buttons positioned on either side of the cheek riser to switch between the two or more positions. The one or more buttons may be one or more living hinges. The cheek riser is configured to straddle a carrier which is attached to the stock. The riser is configured to slide up and down on tracks on the carrier. Each button is configured to hold a pin which engages a slot with positions at each end which positively lock the cheek riser in place.

The adjustable cheek riser described herein may incorporate a living hinge. A living hinge is a thin flexible hinge, or flexure bearing, made from the same material as the two rigid pieces that it connects. The living hinge may be thinned or scored to increase flexibility, allowing the hinge to bend consistently along its axis. The living hinge may be a uniform structure, comprised of the same material as the two pieces that it connects. The living hinge and surrounding structure may be molded in a single step. The living hinge may operate by bending of materials, which causes motion at a microscopic level, so friction is very uniform. A living hinge is designed to yield minimal friction and minimal wear, as well as a low cost and ease of manufacturing. Plastic living hinges may be manufactured by an injection molding operation that forms the parts at one time in a single piece, and if correctly designed and constructed, it can remain functional over the life of the part. It is contemplated that the living hinge described herein may be formed by injection molding of materials comprising polyethylene and polypropylene, or alternative resins. Polyethylene and polypropylene, for example, have excellent fatigue resistance.

A set of locking elements may be used to create a locking engagement between a living hinge mechanism on an adjustable cheek riser and a base. It is contemplated that the locking elements should be formed of a sturdy material so that they do not deform or wear with use. The locking element may be a pin, a spring-loaded button, a cam, a button, a fully enclosed button, or a protrusion mated with a corresponding recess. The locking element may be formed, for example, of polymer or metal.

It is contemplated that movement of an adjustable cheek riser through various positions may be accomplished via means other than a living hinge. For example, an alternate release mechanism may be provided such as a button, lever, or the like, to switch a locking element between a locked and unlocked position and, thereby, restricting and permitting height adjustment of adjustable cheek riser.

The adjustable cheek riser and the base may form a snap fit engagement with a carrier. In some embodiments, the carrier may be mounted to the rear end of a firearm through an extension at a forward end of the carrier. The carrier and extension are designed for easy attachment and removal to a firearm, without use of tools. The extension may be mounted using a clip to secure it in place. In some embodiments, the carrier may be incorporated directly into the stock of a firearm.

The adjustable cheek riser and the base may be formed from filled nylon polyimide, in one embodiment. The carrier may be formed from stamped metal, in one embodiment. The adjustable cheek riser described herein is designed to provide a gradual smooth transition for resting the cheek to. The adjustable cheek riser described herein is designed to provide comfort for a user's cheek.

The system and method described in the present disclosure provide an adjustable cheek riser which is configured to provide clearance for necessary mounting structures. The adjustable cheek riser described herein is designed to clear both the QD sling mount and the traditional sling mount. Clearance may be provided by a gradual taper at a forward end of a comb extension member. Different degrees of tapering and/or different shapes may be used to provide clearance for use with different optics.

Turning now to the drawings to illustrate examples of embodiments of the present teachings, FIG. 1 details a perspective view of an example cheek riser described herein. Living hinge 12 is illustrated as a wing-shaped cut out, with one uncut edge, positioned on a lateral side of comb extension member 11. Comb extension member 11 forms the moving part of adjustable cheek riser 10 designed for resting a user's cheek during aiming and firing. Living hinge 12 is configured with grip 28 to prevent slipping of the fingers of a user during adjustment of adjustable cheek riser 10. Comb extension member 11 is configured with a contoured nose 14, which is sloped down at a forward end to allow for clearance for carrier 30. Contoured nose 14 is sloped down to mate with carrier 30 in a streamlined fashion and is formed to contour around the edges of base 20. An inside edge of comb extension member 11 is configured with a groove 24. Groove 24 enables sliding of comb extension member 11 with respect to base 20 (shown in FIGS. 4-11).

Figure 2:
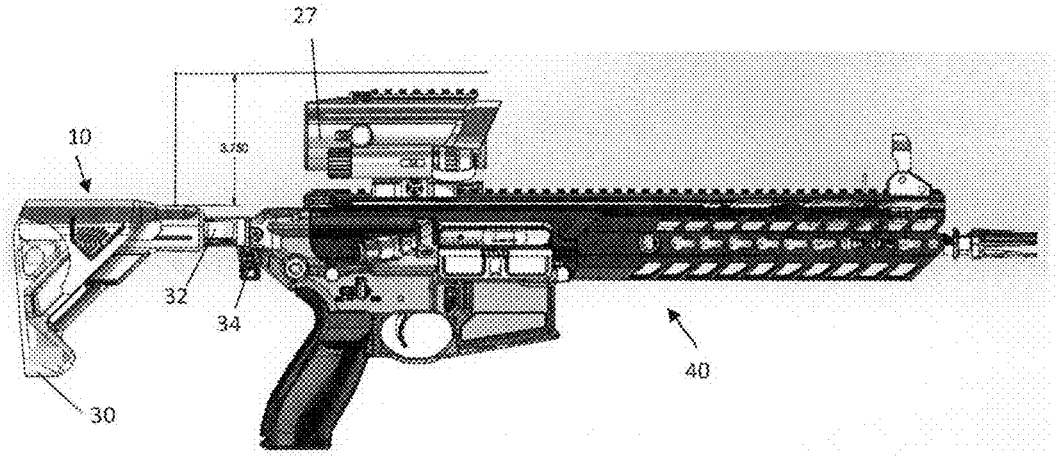
FIG. 2 is a side view of a cheek riser configured on a firearm in a down position, in accordance with one embodiment of the present disclosure.
Figure 3:
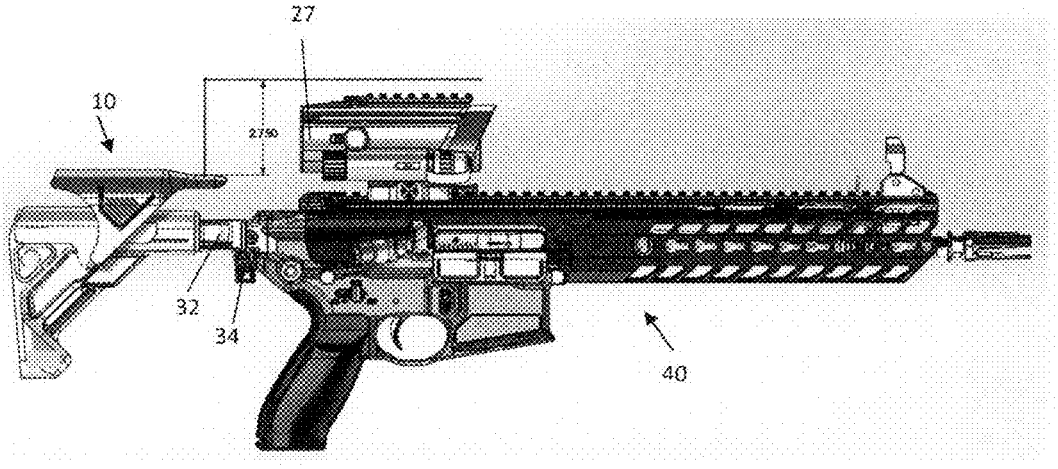
FIG. 3 is a side view of a cheek riser configured on a firearm in an up position, in accordance with one embodiment of the present disclosure.

FIGS. 2-3 illustrate adjustable cheek riser 10 on carrier 30 attached to the rear end of a firearm 40. In FIG. 2, adjustable cheek riser 10 is shown in the down position. In FIG. 3, adjustable cheek riser 10 is shown in the up position. Extension 32 at a forward end of carrier 30 slides into a slot in the rear end of firearm 40 and is secured by locking down clip 34.

In some embodiments, as shown for example in FIG. 2, with the cheek riser in the down position, there is about 3.5" to 4" of distance between the stock and the center line of sight that may be mounted to the top of a magnified optic. In some embodiments, as shown for example in FIG. 3, when the stock is in the up position, the distance to a sight 27 that is mounted to the magnified optic is greatly reduced, allowing for a comfortable and stable view of sight 27 by a user. The reduced distance may be between about 1.5" to about 3". In a specific embodiment, the reduced distance is, for example, about 2.75".

Figure 4:
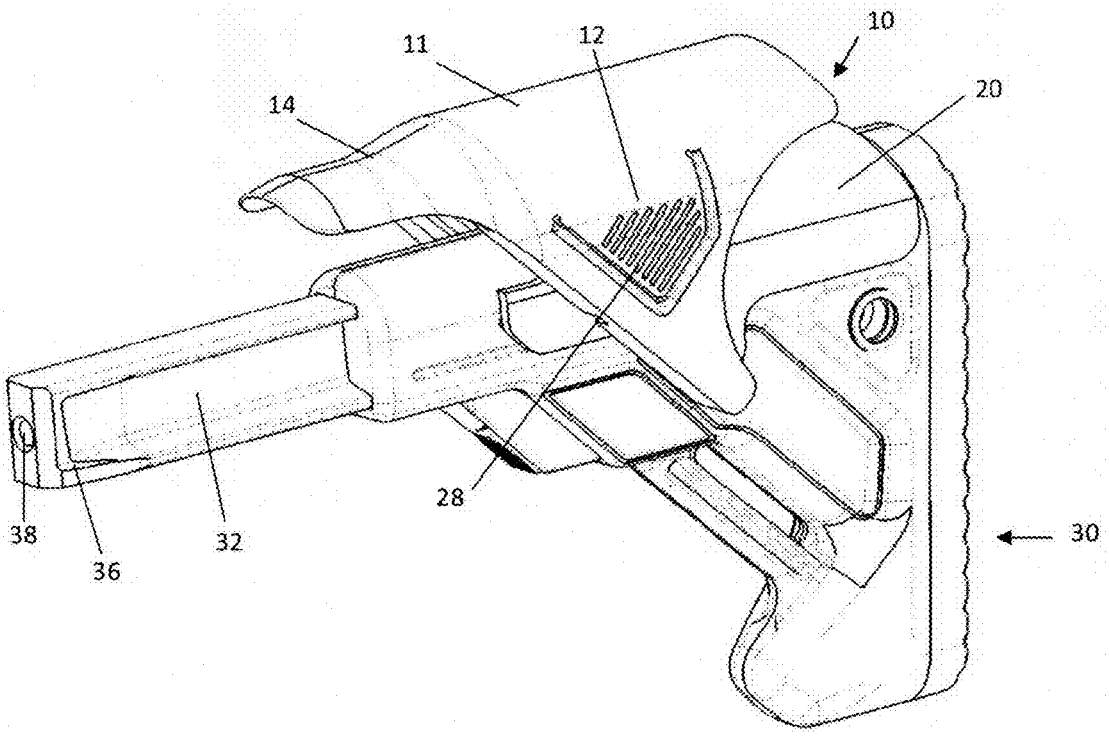
FIG. 4 is a perspective view of a cheek riser on a stock in an up position, in accordance with one embodiment of the present disclosure.
Figure 5:
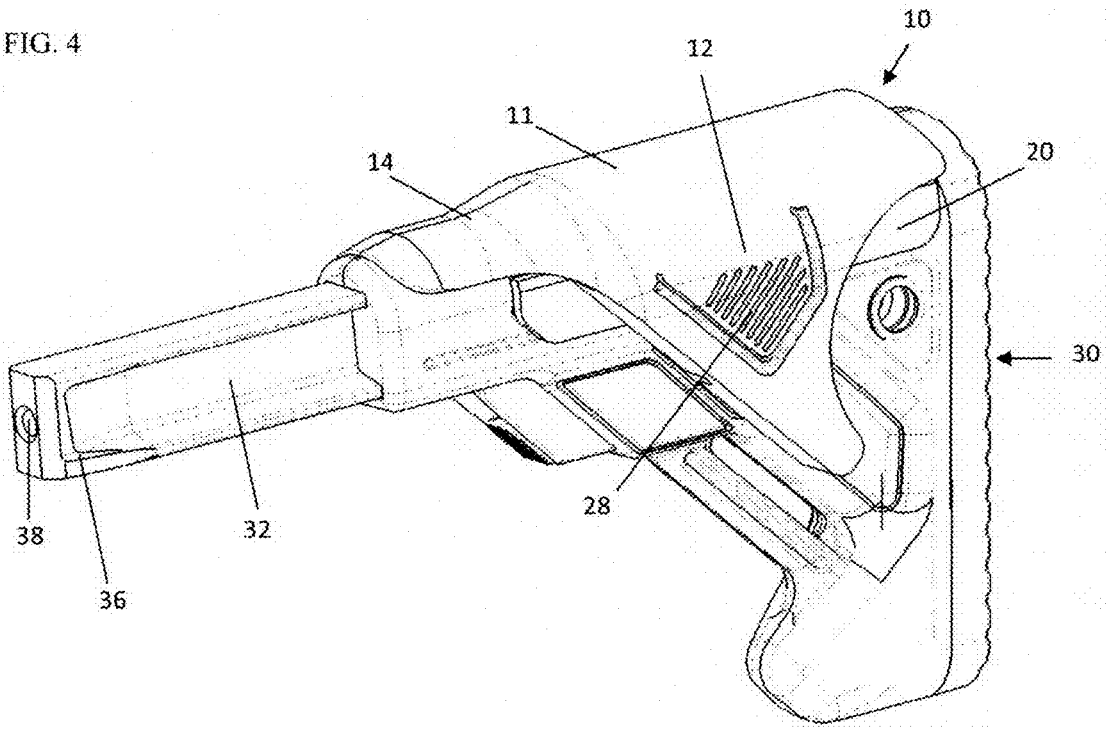
FIG. 5 is a perspective view of a cheek riser on a stock in a down position, in accordance with one embodiment of the present disclosure.
Figure 6:
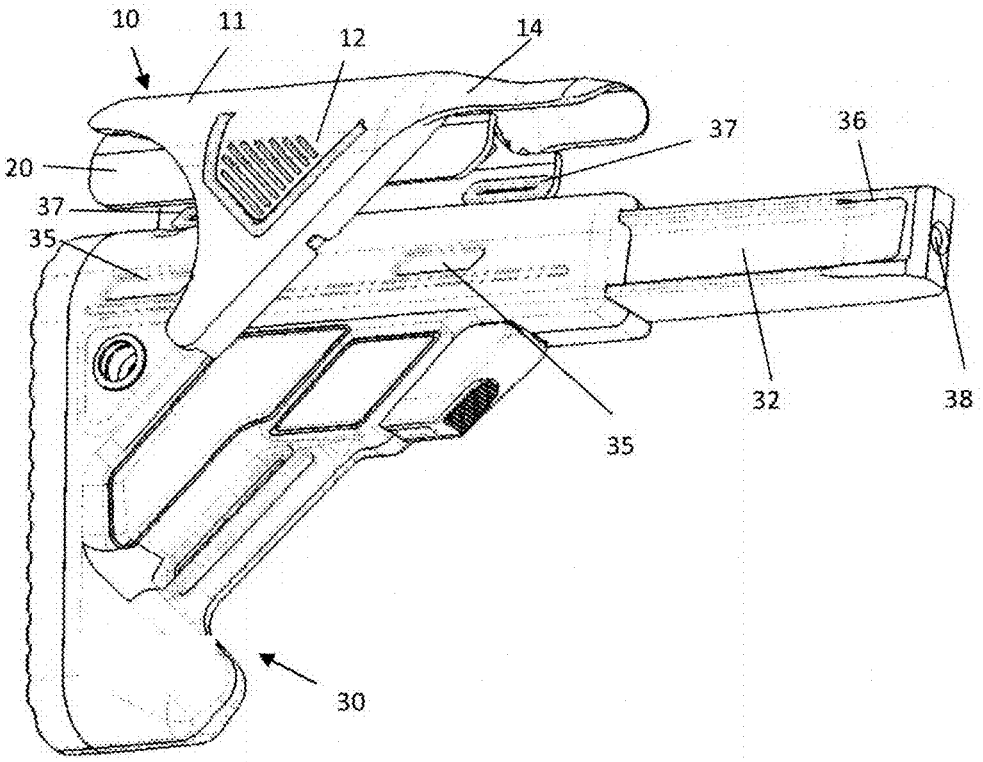
FIG. 6 is a perspective view of a cheek riser on a stock in an up position, in accordance with one embodiment of the present disclosure.

FIGS. 4-7 show perspective views of adjustable cheek riser 10 in various configurations achievable with the design described herein. Both the comb extension member 11 and the base 20 are movable with respect to carrier 30. FIG. 4 illustrates comb extension member 11 positioned in an up position, with base 20 positioned in a down position. FIG. 5 illustrates comb extension member 11 and base 20 positioned in a down position. FIG. 6 illustrates comb extension member 11 and base 20 removed from engagement with carrier 30. A set of protrusions 37 are positioned on an inside surface of base 20. A set of recesses 35 are positioned on an outside top surface of carrier 30. A set of protrusions 37 are configured to be mated to a set of recesses 35 as base 20 slides onto carrier 30 to hold base 20 in place on carrier 30. The set of protrusions 37 and the set of recesses 35 are configured to provide a snap fit connection between base 20 and carrier 30. The set of protrusions 37 and the set of recesses 35 are configured to provide a snap fit connection between adjustable cheek riser 10 and carrier 30. In the illustrated embodiment, four protrusions 37 mate with four recesses 35. Protrusions 37 and recesses 35 can be a geometric shape (e.g., circle, ellipse, rectangle, square, etc.), and can have a polygonal cross-sectional profile (e.g., triangular, square/rectangular, hexagonal octagonal, etc.). In the illustrated embodiment, protrusions 37 and recesses 35 are rectilinear.

Figure 7:
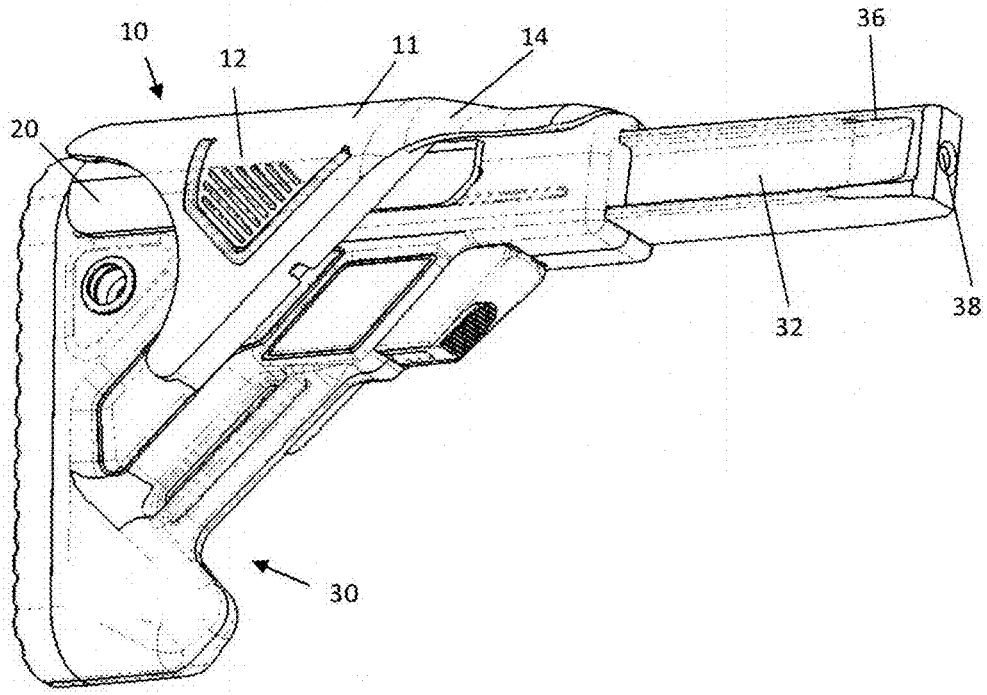
FIG. 7 is a perspective view of a cheek riser on a stock in a down position, in accordance with one embodiment of the present disclosure.

FIG. 7 illustrates comb extension member 11 and base 20 in a down position. FIGS. 4-7 highlight the forward end of extension 32, including hole 38 and tapered contour 36. The forward end of extension 32 is designed to mate with corresponding components on a rear end of firearm 40 and enable a secure connection of carrier 30 to firearm 40 (see FIGS. 2-3). The female connection of hole 38 may mate with a male connection on firearm 40. The male connection may be, for example, an extension or protrusion. The tapered contour 36 is designed to mate with a corresponding contour on the rear end of firearm 40.

Figure 8:
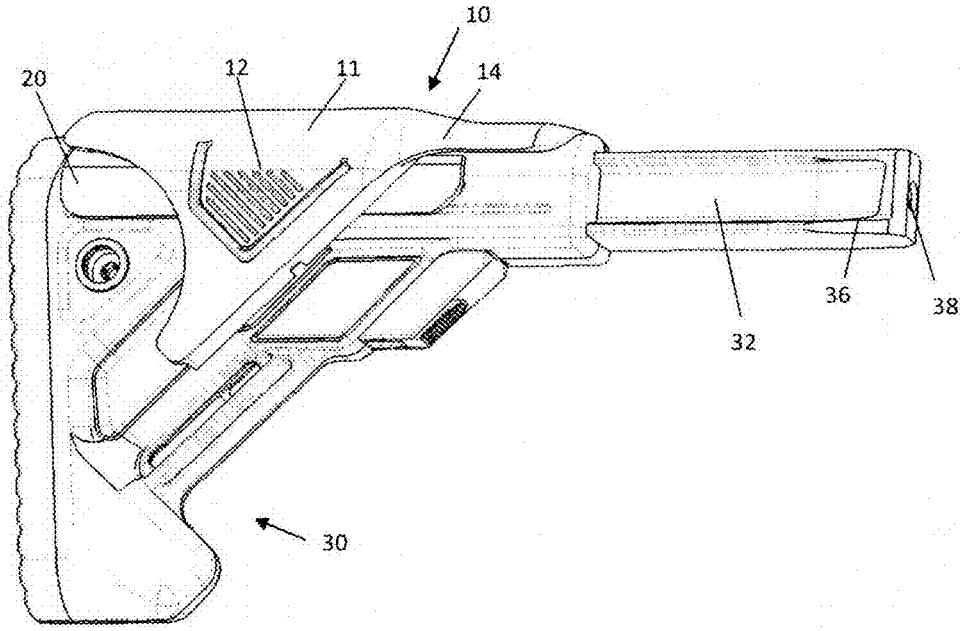
FIG. 8 is a side view of a cheek riser on a stock in a down position, in accordance with one embodiment of the present disclosure.

FIG. 8 illustrates a side view of adjustable cheek riser 10, wherein comb extension member 11 and base 20 are positioned in a down position on carrier 30.

Figure 9:
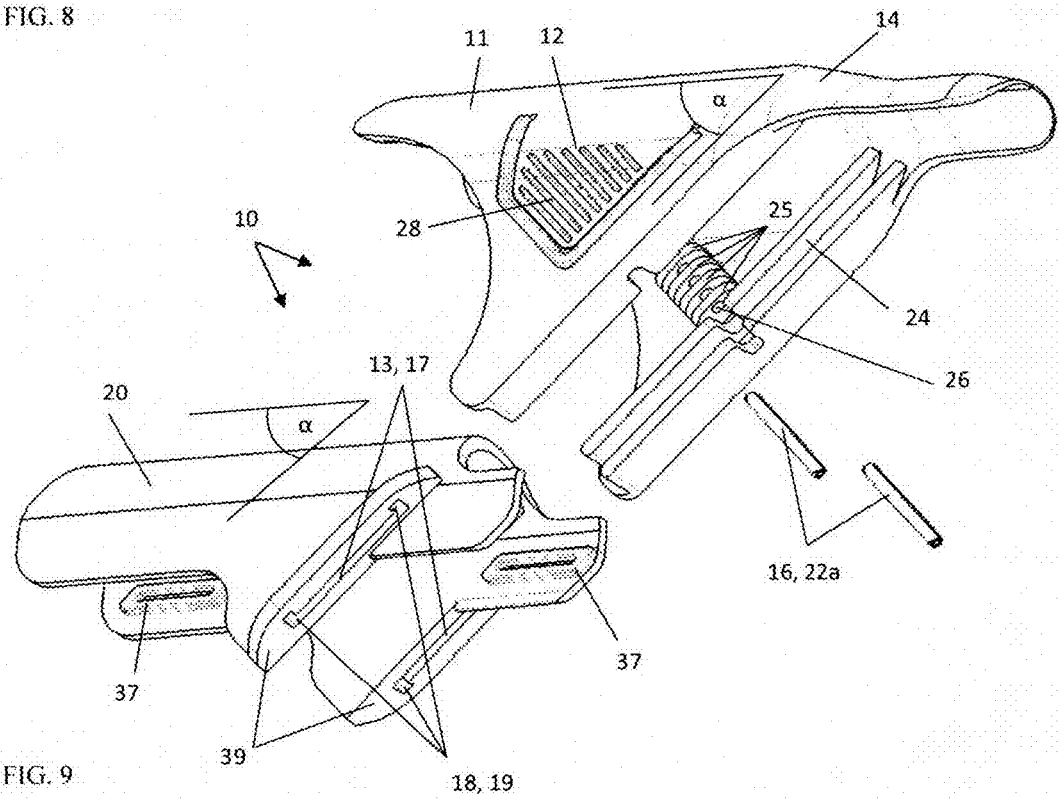
FIG. 9 is an exploded view of a cheek riser, in accordance with one embodiment of the present disclosure.

FIG. 9 shows an exploded view of adjustable cheek riser 10. During operation, a locking element 16 would be used for locking down sliding of comb extension member 11 with respect to carrier 30. In one embodiment, pins 22*a* would be positioned inside a set of holes 26 in a set of tabs 25. The set of tabs may be formed by injection molding and positioned on the inside surface of comb extension member 11. A pin 22*a* and a set of tabs 25, each tab 25 configured with a hole 26, would be used as the locking element 16 for each living hinge mechanism, in one embodiment. Pins 22*a* may be spring-loaded. A pair of semi-circular tabs 39 extend axially outward from base 20. Locking element tracks 17 and locking element recesses 18 are contained on semi-circular tabs 39. Shown in FIG. 9, the pair of semi-circular tabs 39 is positioned at an angle $\alpha$ with respect to the longitudinal axis of base 20. Similarly, groove 24 extends along a length at an angle $\alpha$ with respect to the longitudinal axis of comb extension member 11, and the longitudinal axis of the firearm. Angle $\alpha$ can be less than 90 degrees and may vary from 5 degrees to 85 degrees, from 30 degrees to 60 degrees, or from 40 degrees to 50 degrees depending on the specifics of the firearm being used therewith. Groove 24 enables sliding of comb extension member 11 with respect to base 20, and comb extension member 11 slides along an axis that is defined by angle $\alpha$. Semi-circular tabs 39 are configured to slide along the length of groove 24 as comb extension member 11 slides up and down with respect to base 20. The length of locking element tracks 17 is configured to be the desired length of travel of comb extension member 11. Locking element track 17 may be a pin track 13. Locking element recess 18 may be a pin recess 19.

One locking element recess 18 is required for each position at which the comb extension member 11 will stop and lock into place. In the embodiment shown in FIGS. 9-11, there are two positions at which comb extension member may be locked, a top position and a bottom position. In alternate embodiments, comb extension member may be locked at one or more intermediate positions. As a user depresses living hinge 12, locking element 16 is disengaged from locking element recess 18. As a user pulls up or pushes down on comb extension member 11, adjustable cheek riser 10 is raised or lowered, respectfully. As a user releases living hinge 12, locking element 16 finds engagement with a locking element recess 18 and the height of comb extension member is fixed in position.

Figure 10:
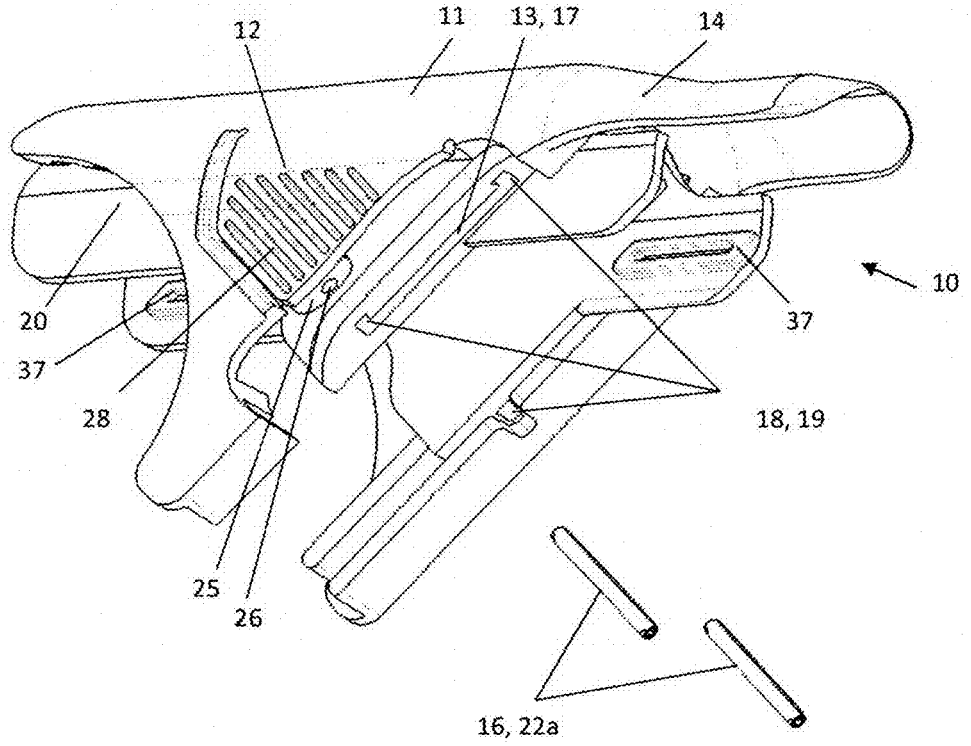
FIG. 10 is a partially exploded view of a cheek riser, in accordance with one embodiment of the present disclosure.

FIG. 10 shows a partially exploded view of adjustable cheek riser 10. In the illustrated embodiment, locking element 16 is pin 22*a*, locking element track 17 is pin track 13, and locking element recess 18 is pin recess 19. During adjustment of adjustable cheek riser 10, pin 22*a* is configured to switch between protruding through pin track 13 and pin recess 19. Pin 22*a* protrudes through pin track 13 during adjustment of adjustable cheek riser 10 when a user has depressed living hinge 12. Pin 22*a* protrudes through pin recess 19 when a user has released living hinge 12 and adjustable cheek riser 10 is in a fixed position with respect to carrier 30. Pin 22*a* is configured to be insertable through hole 26 in a set of tabs 25. Locking element 16 and/or pin 22*a* may be spring-loaded.

Figure 11:
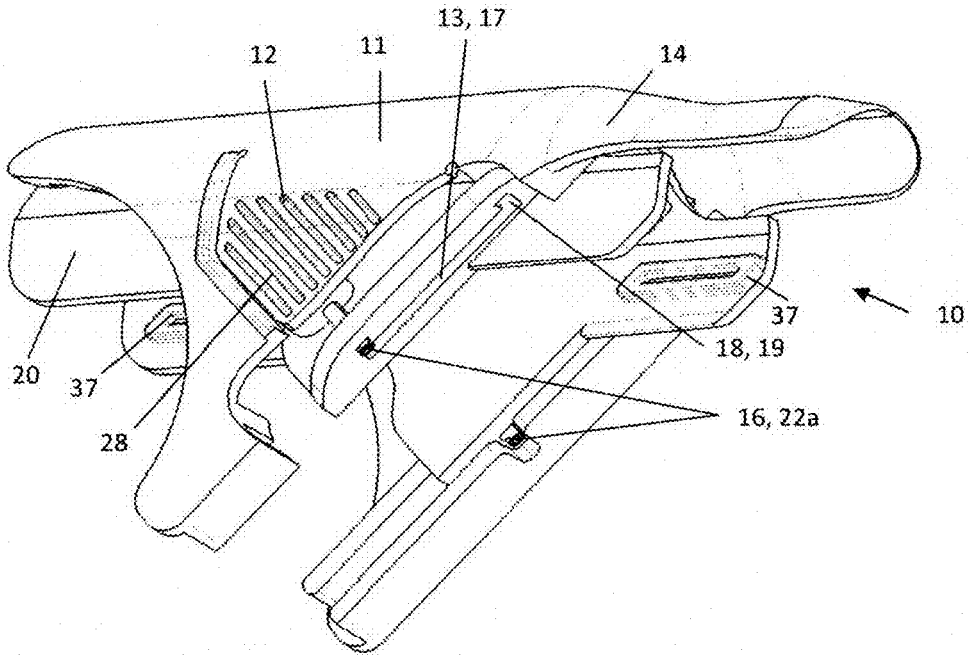
FIG. 11 is a perspective view of a cheek riser, in accordance with one embodiment of the present disclosure.

FIG. 11 illustrates comb extension member 11, base 20, and pin 22*a* in an assembled configuration. In the illustrated embodiment, pin 22*a* extends through hole 26 in a set of tabs 25 (shown in FIG. 10) and then through pin recess 19 as adjustable cheek riser 10 is positioned in a locked position.

Figure 12:
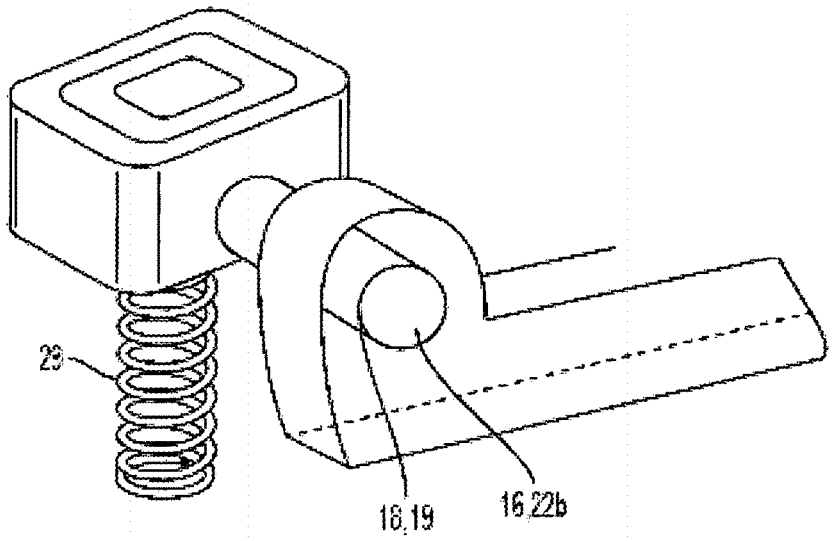
FIG. 12 is a perspective view of a locking element for engaging a cheek riser at a desired position, in accordance with one embodiment of the present disclosure.
Figure 13:
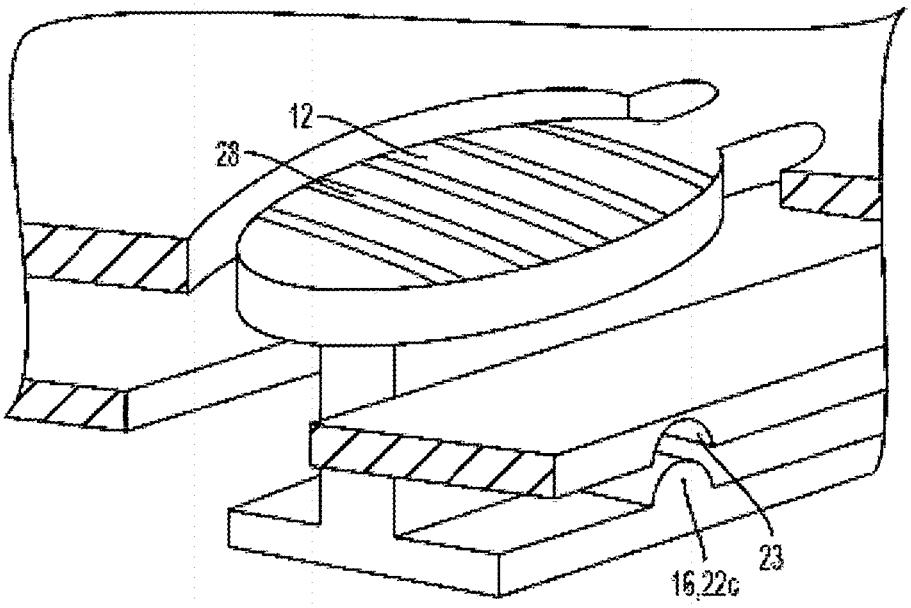
FIG. 13 is a perspective view of a locking element for engaging a cheek riser at a desired position, in accordance with one embodiment of the present disclosure.

FIGS. 12-13 illustrate alternative embodiments of living hinge 12 and locking element 16. In FIG. 12, fastener 22*b* serves as one embodiment of locking element 16. In one embodiment, depression of living hinge 12, causes depression of spring 29 and subsequently clears fastener 22*b* from locking element recess 18. Depression of living hinge 12 thus enables adjustment of adjustable cheek riser 10. Release of living hinge 12, and subsequently of spring 29, causes fastener 22*b* to extend through locking element recess 18. Thus, as a user depresses living hinge 12, fastener 22*b* is disengaged from locking element recess 18. As a user pulls up or pushes down on comb extension member 11, adjustable cheek riser 10 is raised or lowered, respectfully. As a user releases living hinge 12, fastener 22*b* finds engagement with a locking element recess 18 and the height of comb extension member is fixed in position.

In FIG. 13, protrusion 22*c* serves as one embodiment of locking element 16. Protrusion 22*c*, in the illustrated embodiment, is an elongated semi-circular bump which is mated with a corresponding semi-circular recess 23 to form locking engagement of comb extension member 11. As a user grasps grip 28 and depresses living hinge 12, protrusion 22*c* is disengaged from corresponding semi-circular recess 23. As a user pulls up or pushes down on comb extension member 11, adjustable cheek riser 10 is raised or lowered, respectfully. As a user releases living hinge 12, protrusion 22*c* finds engagement with semi-circular recess 23 and the height of comb extension member is fixed in position.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

What is claimed is:

1. An adjustable cheek riser for a firearm comprising:

a comb extension member configured to move between at least an expanded configuration and a retracted configuration;

at least one living hinge integral with the comb extension member; and at least one pin, the at least one pin being configured to switch between a locked and an unlocked position upon activation of the living hinge.

2. The adjustable cheek riser of claim 1, wherein the at least one pin passes through a hole or slot on a surface in a lower portion of the comb extension member.

3. The adjustable cheek riser of claim 2, wherein the at least one pin is further configured to move into a pin recess for locking the position of the comb extension member.

4. The adjustable cheek riser of claim 3, wherein the at least one pin is further configured to slide along a pin track during switching between the expanded configuration and the retracted configuration.

5. The adjustable cheek riser of claim 4, wherein the comb extension member is configured to stop on at least one intermediate position between the expanded configuration and the retracted configuration.

6. The adjustable cheek riser of claim 1, wherein the at least one pin is a spring-loaded pin.

7. The adjustable cheek riser of claim 1, wherein the at least one living hinge is positioned on at least one side of the comb extension member.

8. The adjustable cheek riser of claim 7, wherein activation of the at least one living hinge is configured to release a locking mechanism and slide a tab along a groove.

9. The adjustable cheek riser of claim 8, wherein the tab and the groove are positioned at an angle of about 45 degrees with respect to the axis of firing.

10. The adjustable cheek riser of claim 1, wherein the comb extension member is positioned on a base.

11. The adjustable cheek riser of claim 10, wherein the base is positioned on a carrier.

12. The adjustable cheek riser of claim 11, wherein the base is secured on the carrier using a snap fit connection.

13. The adjustable cheek riser of claim 11, wherein the carrier is positioned at a rear end of a firearm.

14. The adjustable cheek riser of claim 13, wherein a tapered contour and a hole at a forward end of an extension mate the extension of the carrier to the rear end of the firearm.

15. The adjustable stock of claim 6, wherein the at least one pin is biased toward a locked position.

16. An adjustable cheek riser for a firearm comprising:

a comb extension member configured to move between at least an expanded configuration and a retracted configuration;

at least one button integral with the comb extension member; and at least one pin, the at least one pin being configured to switch between a locked and an unlocked position upon activation of the button.

17. A method for adjusting a cheek riser of a firearm, the method comprising:

pressing on a grip portion of at least one living hinge integral with the cheek riser;

shifting a locking mechanism from a locked position to an unlocked position; and moving the cheek riser to a desired height.

18. The method for adjusting a cheek riser of a firearm of claim 17, further comprising releasing the grip portion of the at least one living hinge.

19. The method for adjusting a cheek riser of a firearm of claim 18, further comprising shifting the locking mechanism from an unlocked position to a locked position.

* * * * *